US005193748A

United States Patent [19]

Wittersheim et al.

[11] Patent Number: 5,193,748

[45] Date of Patent: Mar. 16, 1993

[54] SPRAY HEAD FOR SPRAY DEVICE

[76] Inventors: Adam Wittersheim, Ale Darmstadter Strasse 41, D-6109 Muhltal; Georg W. Arras, Nibelungenstrasse 42, D-6101 Reichelsheim, both of Fed. Rep. of Germany

[21] Appl. No.: 720,439

[22] PCT Filed: Oct. 15, 1990

[86] PCT No.: PCT/EP90/01741

§ 371 Date: Aug. 23, 1991

§ 102(e) Date: Aug. 23, 1991

[87] PCT Pub. No.: WO91/06377

PCT Pub. Date: May 16, 1991

[30] Foreign Application Priority Data

Nov. 2, 1989 [DE] Fed. Rep. of Germany ..... 3936365

[51] Int. Cl.[5] ..... B05B 9/04; B05B 7/12; B05B 15/02; B65D 83/66

[52] U.S. Cl. ..... 239/337; 239/373; 239/415; 239/106; 222/400.7

[58] Field of Search ..... 239/337, 340, 346, 346, 239/351, 353, 354, 364, 365-369, 371, 373, 415, 106, 112, 113; 222/148, 630, 637, 400.7, 400.8

[56] References Cited

U.S. PATENT DOCUMENTS 1,382,641 6/1921 Heinrich ..... 239/415
3,197,145 7/1965 Kramer ..... 239/415
3,786,990 1/1974 Hagfors ..... 239/112

FOREIGN PATENT DOCUMENTS 201062 1/1939 Switzerland .
591609 8/1947 United Kingdom ..... 239/351

*Primary Examiner*—Andres Kashnikow
*Assistant Examiner*—Karen B. Merritt
*Attorney, Agent, or Firm*—Birch, Stewart, Kolasch & Birch

[57] ABSTRACT

A spray head (10) for a spraying device operated by pressing down an actuating cap (70) against the initial tension of a spring (30) allowing to atomize and focus-spray a sprayable and preferably liquid product by compressed air. The spray head is provided with a spray nozzle (58) wherein the compressed air and the product, up to here transported in two different canals, through an ascending tube (50) immersed into a product container, are mixed, atomized and focus-sprayed. Spray head (10) shows two separate valves with initial tension in closing position (22; 24) of which the first valve (22) is positioned in a passage canal of the air pressure canal forwarding the compressed air to the spray nozzle (58) and the container interior, and the second valve (24) is positioned inside the product canal by which the product is transported through the ascending tube (50) from the container to the spray nozzle (58). The actuating cap (70) includes two actuating taggets (72; 74) each of which are allocated to one of the valves which unlock when pressing down the actuation elements. The actuating taggets (72; 74) are dimensioned to allow the actuating tagget (72) allocated to the first valve (22) to contact the relevant valve closing part (26; 28) when pressing down the actuation element (70) before the relevant actuating tagget (74) allocated to the second valve (24).

11 Claims, 2 Drawing Sheets

SPRAY HEAD FOR SPRAY DEVICE

BACKGROUND OF THE INVENTION

1. Field of the Invention

The invention relates to a spray head for a spray device, which spray head is manually actuatable by pressing on an actuating element provided with an actuating surface against a pre-stretched spring, by means of which a sprayable, preferably liquid preparation in a container of the spray device can be sprayed out in atomized form, in a directed manner, by means of compressed air fed via an air-supply line from a motor-driven air pump as a source of compressed air, with a spray nozzle in which the compressed air fed to it, and the preparation fed to it via a riser tube, which had been separate from each other up to that point, are mixed, atomized and sprayed in a directed manner.

2. Description of Related Art

Spray devices which permit the spraying of liquids, e.g. pharmaceutical or cosmetic preparations, are known in a variety of designs. Here, as a rule, the liquid is sprayed out in a spray nozzle of the spray device in an atomized and directed manner by means of a stream of propellant gas.

Air, supplied via a hand pump (rubber ball pump) was originally used as the propellant gas. Later, special gases were used as propellant gases, in the product container itself or charged into a separate propellant gas container. However, recently—at least when fluorinated hydrocarbons are involved—their use has fallen out of favor, in order to prevent suspected environmental damage due to such propellant gases. The propellant gases more recently used as substitutes for fluorinated hydrocarbons are also objectionable, because they are sometimes flammable (propane) and during spraying, in combination with the oxygen of the surrounding air, they can explode with the formation of a flame jet, if they are inadvertently ignited by an open flame or an electrical spark. Other propellant gases used as substitutes (e.g. $CO_2$) have the disadvantage that they must be charged into the container under very high pressure in order to assure that the entire contents of the container can be expelled in finely atomized form in the required manner. To make such highly pressure-resistant containers naturally requires an appropriately rugged and therefore costly manufacture of these containers. To an increasing extent, therefore, there has been a return to the use of hand pumps having a relatively simple construction, which supply ambient air as the propellant gas. It has been shown that the atomization and spray performance of such hand pumps, even though they are more advantageous from the environmental viewpoint, is relatively poor, because the supply of air that can be produced by actuation of the hand pump using (usually) one finger is very low, in terms of both the quantity of air as well as the air pressure, so that these hand pumps deliver only small quantities of spray, and the size of the droplets in the sprayed stream is also undesirably large in many cases.

Larger quantities of air at higher pressure can be supplied by external sources of compressed air of sufficient capacity, e.g. motor driven air pumps. This has recently led to the development of spray devices driven by compressed air, where the compressed air is supplied by pumps driven by electric motors. As long as these devices are used for the spraying of residue-free sprayable liquids, they can also be used advantageously owing to their satisfactory spray performance.

Problems arise if the liquids to be atomized or sprayed leave adherent solid or sticky residues, since such residues can deposit in the calibrated conduits, which are often very small, in the region of the spray nozzle. This rapidly impairs the spraying function, and after a short time nothing at all is expelled any longer, if the nozzle is not constantly cleaned. In addition, it is observed in such devices that small quantities of liquid continue to be delivered after use. These then dry within the conduits of the spray device and the spray nozzle, as well as on the outside of the spray nozzle; this likewise impairs the functioning of the device, even leading to total failure.

SUMMARY OF THE INVENTION

The objective of the invention is therefore to provide a spray head for such spray devices which operate with external sources of compressed air, which is also suitable for the atomization or the spraying of liquids which are critical in terms of the formation of deposits within the spray head or in or ahead of the spray nozzle, and which provide the desired spraying function reliably, without constant cleaning, even over long periods of use.

Starting with a spray head of the kind mentioned at the outset, this objective is achieved, in accordance with the invention, by providing a spray head with two separate valves, held in the closed position by pre-stretched springs, where the first valve is located in a conduit of the compressed air passage to the interior of the product container from which the compressed air is fed to the spray nozzle, and the second valve is located in the preparation conduit which carries the preparation via the riser tube from the container to the spray nozzle; by providing that the actuating element has two actuating valve stems, one of which runs to each of the valves, and opens the valves when the operating element is pressed; and by providing that the actuating valve stems are of such dimensions that when the actuating element is pressed, it engages the actuating valve stem running to the valve-closure element of the first valve before the actuating valve stem running to the corresponding element of the second valve. In this way, a staggered release of the valves is maintained, in the sense that the compressed air which places the preparation container under pressure and thus drives the preparation out via the riser tube is first delivered into the interior of the container, and at the same time compressed air is also sprayed out at the spray nozzle, while the delivery of the liquid preparation to the spray nozzle is delayed. Thus the conduit system, including the spray nozzle, is blown free with pure compressed air. When the spraying process is interrupted, the valves are then closed in reverse order, i.e. the delivery of the preparation to spray nozzles is interrupted first, while pure compressed air flows through the conduit system of the spray head and hence all residues of liquid contained in this conduit system are carried along and are blown out of the spray head. Accordingly, since no residues of the preparation remain in the spray head, there can be no deposition or formation of deposits, and the functioning of the spray head cannot be impaired by such deposits.

In a spray device whose air pump is driven by an electric motor which is switched on by actuating a push-button which is electrically connected into the power circuit for the electric motor and is held in the open position by a stretched spring, a further embodiment is desirable such that the push-button and the first valve are connected in series, and the pre-stretching of the spring which holds the push-button in the open position is made to be sufficiently smaller than that of the spring which is stretched to hold the valve-closure body in the closed position so that the push-button is already closed before the first valve starts to open. Thus the air pump starts up before the first valve opens, so that compressed air is available with no time delay when the valve opens.

In a preferred embodiment of the invention, the actuating element is constructed as an actuation cap which is fastened, so as to be displaceable in the direction of valve actuation, onto a spray head housing which can be mounted tightly on the preparation container. The spray nozzle is located in this housing and at least sections of the compressed air and preparation conduits which are fed separately into the region of the spray nozzle are located there as well; the sections of the two conduits open into pass-throughs, at their ends facing the spray nozzle, these being spaced apart from one another and arranged parallel to the displacement direction of the actuating cap. The conduits are open at both the end facing the actuating cap and the end facing the preparation container, and the valve stems of the valve-closure bodies pass through them.

The valve seat of one of the valves is then located ahead of the pass-through facing the preparation container, and the valve body which closes the respective valve seat is located in a longitudinally displaceable manner so as to close the respective pass-through conduit at the preparation-container end, and is pressed against the valve seat by a spiral spring. The part of the preparation conduit which forms the pass-through opens at the container end in a riser tube which dips into the contents of the container, while the part of the compressed air conduit which forms the pass-through conduit opens in the preparation container above the contents of the container.

In an advantageous embodiment of the invention, the valve seats of the two valves can each be formed by a sealing disk located on the preparation-container side of the spray head housing ahead of the pass-throughs. These disks are held onto the spray head housing by means of a valve housing which holds both valves and is attached to the side of the spray head housing which faces the preparation container.

The part of the preparation conduit which forms the pass-through in the spray head housing is suitably closed at the side facing the actuating cap by an elastically deformable membrane, which traverses an intermediate space between the free end of the valve stem of the associated valve at the side facing the actuating cap and the free end of the actuating stem associated with this valve. Thus this membrane prevents the escape from the pass-through of preparation conveyed via the preparation conduit, without preventing the opening of the valve by the actuating stem of the actuating cap.

A tubular extension projects from the inner surface of the actuating cap; it surrounds, at a distance, the actuating stem for the compressed air valve and engages in the opening, facing the actuating cap, of the part of the compressed air conduit which forms the pass-through. The tubular extension is led into the opening of the pass-through, in a manner so as to be displaceable in the direction of actuation, and to provide a seal against the escape of compressed air. The entrance opening of a connection for the compressed air from the compressed air source opens into the annular space formed between the tubular extension and actuating stem. That is, the compressed air is thus admitted via the connection which is provided at the actuating cap which is displaceable relative to the spray head housing. The compressed air line which is fed to this connection must therefore permit the movement of the actuating cap which takes place when the spray head is actuated; that is, it must have a suitable elastic construction at least in the neighborhood of the connection.

The spray head housing and/or the actuating cap are/is preferably each made of plastic in one piece by injection molding.

The sealing disk and/or the valve housing are/is also made of plastic.

The valve-closure bodies and the valve shafts provided for each of these are advantageously injection molded of plastic in one piece.

In an advantageous embodiment of the invention, each of the valve-closure bodies has a valve plate, on the side facing the preparation container, pressed in a sealing manner against the associated opening in the sealing plate; the valve shaft extends from one flat side of each valve plate, and from the other flat side there extends a guide shaft for the stretched spiral spring which holds the valve plate in the closed position.

In a further advantageous embodiment of the invention, the spray housing has a spray insert with an extended pass-through opening attached to the preparation conduit; the opening of this insert, which is calibrated at the discharge side, is directed into a discharge nozzle opening, which is formed into a nozzle plate located ahead of the spray insert. The inner side of this plate, facing the spray insert, closes off a receiving space located in the spray head housing and connected with the compressed air conduit. A ring slit is located between the opening of the spray insert and the discharge nozzle opening, to allow passage of compressed air flowing in via the compressed air conduit.

For this, the design is preferably such that the section of the extended spray insert which lies within the receiving space is provided with an external thread, onto which is screwed a sleeve-shaped attachment on the spray plate, this attachment being provided with an internal thread and also forming a tight seal against the outside. The contact of the external thread of the spray insert and the internal thread of the sleeve-shaped attachment of the spray plate is designed in such a way that compressed air flowing into the receiving space can flow along to the discharge nozzle opening. This can be assured, for example, by providing one or more longitudinal grooves in the section of the spray insert which has the external thread, the depth of these grooves being greater than the height of the screw threads.

In order permit an optimum adjustment of the nature of the spray jet, in terms of its shape and the droplet size of the preparation, a handle can be provided on the spray plate, projecting from the spray housing, by means of which it is possible to adjust the extent to which the sleeve-shaped attachment of the spray plate is screwed onto the spray insert, and thus to adjust the ring slit between the opening of the spray insert and the discharge nozzle opening.

BRIEF DESCRIPTION OF THE DRAWINGS

The invention is further elucidated in the following description of an example of an embodiment, in connection with the drawing, where.

DETAILED DESCRIPTION OF PREFERRED EMBODIMENTS

Figure 1:
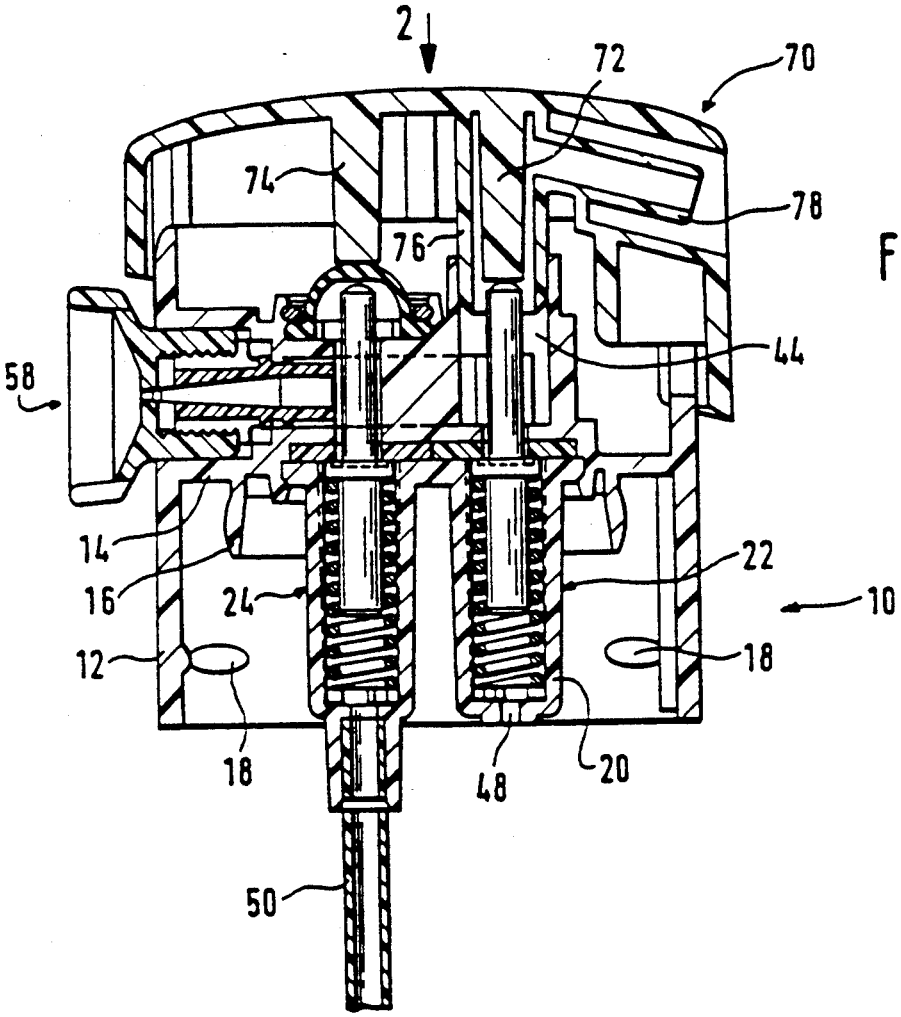
FIG. 1 shows a perpendicular mid-section through a spray head constructed in accordance with the invention, the sectioning plane being indicated by the arrows 1—1 in FIG. 2.
Figure 2:
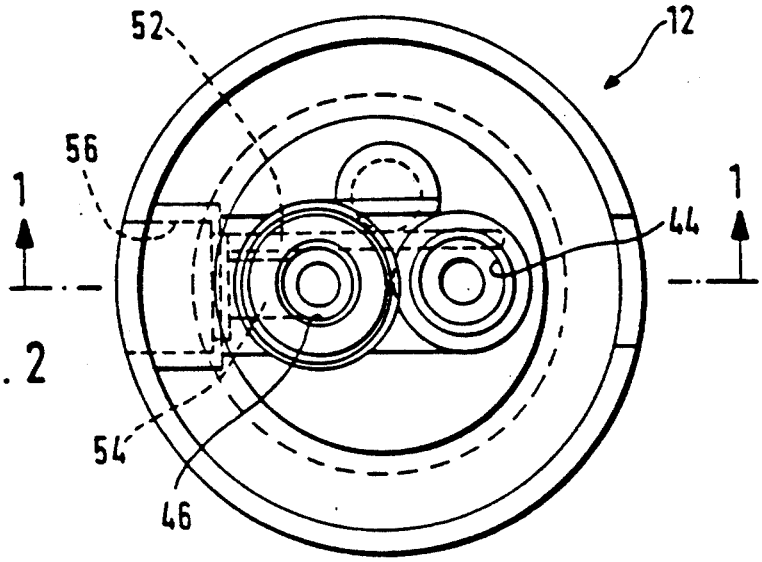
FIG. 2 shows a plan view of the housing of the spray head, viewed in the direction of arrow 2 in FIG. 1.

The spray head in accordance with the invention shown in FIGS. 1 and 2 and designated overall by 10, is part of a spray device, which might be used, for example, for the directed spraying of a liquid hair cosmetic preparation in a hairdressing salon. A large number of liquid preparations used in hairdressing salons could be applied by means of such a spray device; of these, hair-setting lacquer is especially critical, because hair-setting lacquer, by its nature, dries immediately after being applied and then forms a solid, hair-stabilizing layer. Such layer-forming solid deposits must not be allowed to form in spray head 10, because otherwise its functioning will deteriorate, to the point of total failure. The spray device has, in addition to the spray head 10 shown in the drawing, at least one source of compressed air, e.g. an electric motor driven air pump and a preparation container which contains the preparation to be sprayed; this container, as well as the additional parts, e.g. the housing which receives the preparation container and/or the air pump and its drive, as well as the switching devices for starting the pump drive before start-up of the equipment, are not represented, because the invention relates exclusively to the improvement of the functioning of the spray head, in the sense that the latter should be able to reliably spray even critical preparations, such as the hair-setting lacquer mentioned above, for long periods of use, without degradation of its functioning.

Figure 3:
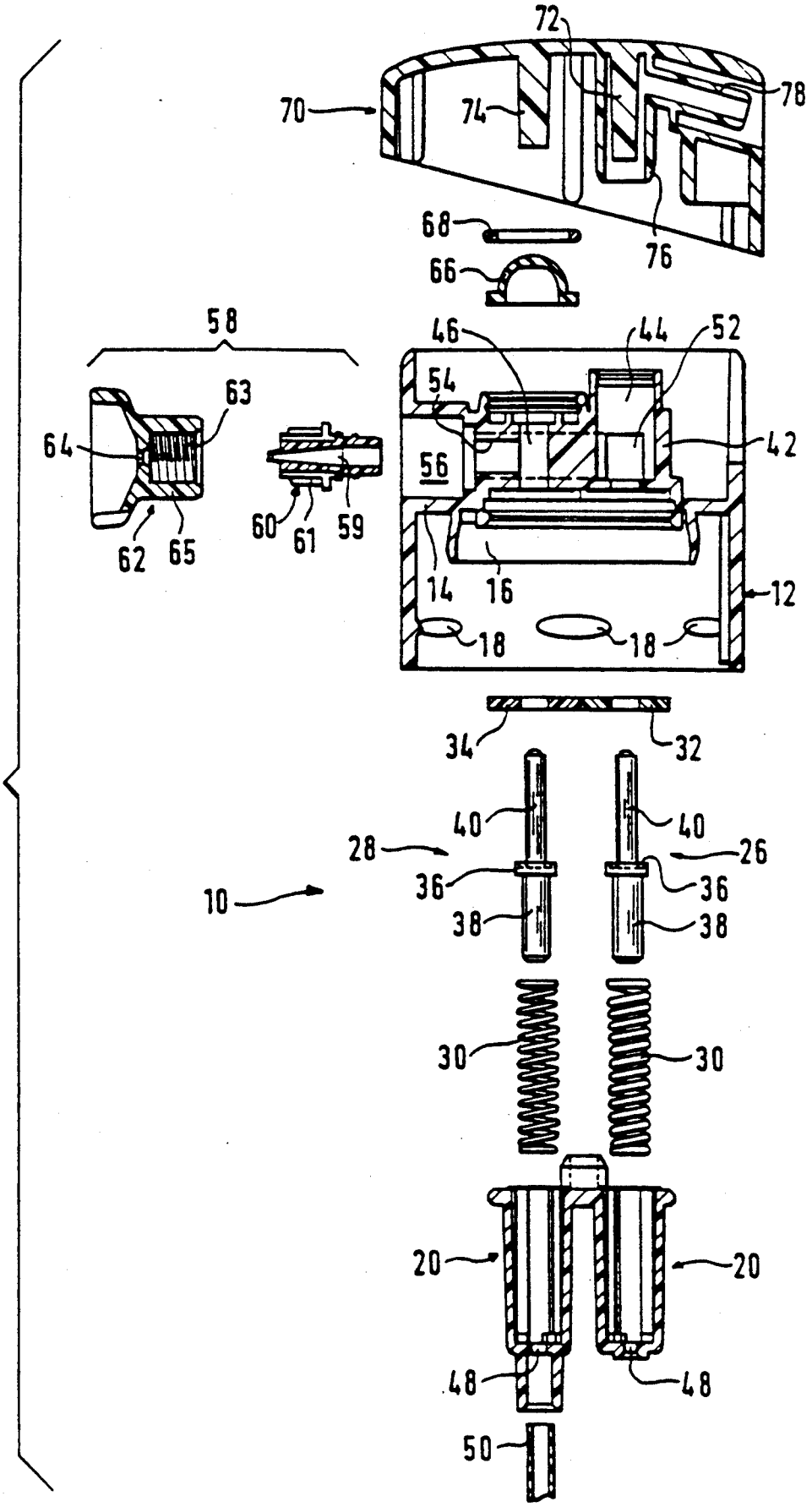
FIG. 3 shows a section view of the spray head, along the sectioning line of FIG. 1, but where the individual parts of the spray head are depicted in an exploded representation.

The spray head in accordance with the invention is made up of a series of parts which can be best recognized in the exploded representation of FIG. 3. They are located together in or on a spray head housing 12, which basically has the shape of a cylinder open at both ends. There is a separating wall 14 in the middle region of the cylindrical wall of the spray head; there are conduits, pass-throughs and receivers for the spray head, as well as valves, etc., in this separating wall, as will be more fully explained below.

An open hollow plug 16 is mounted on the under side of separating wall 14; this plug is open on the side facing the opening of the preparation container and can be pressed into that opening. It seals the mouth of the container. In addition, the wall of the housing has projections 18 in the neighborhood of its lower edge which overlaps the opening of the preparation container; these projections can be locked onto a peripheral ring projection or into a peripheral groove provided on the mouth of the container, in order to fasten spray head 10.

Inside the hollow plug 16 there are located, on the under side of separating wall 14, a valve housing 20 of a pair of valves 22, 24, laterally spaced apart (FIG. 1). Each of these valves has a valve-closure body 26, 28, which can be displaced parallel to the longitudinal central axis of the cylindrical housing wall. Each of these closure bodies is pressed against a sealing disk 32, 34, which is held against the under side of the separating wall by means of a pre-compressed helical spring 30 and forms the valve seat of valves 22, 24. Shafts extend on both sides from the actual valve-closure bodies 26 and 28 enlarged as valve plates 36; these shafts are smaller in diameter than the maximum diameter of valve plate 36, namely, a guide shaft 38 engaging helical spring 30 as well as a valve shaft 40 on the opposite, conically tapered front side. The valve shafts extend through the associated sealing disk 32, 34 and then into pass-throughs 44, 46 in a housing block 42 located on separating wall 14. Of these pass-throughs, 44 has a distinctly greater diameter than the associated valve shaft 40 and greater than that of pass-through 46.

Valve housing 20 has an opening 48 for each of the two valves 22, 24 at its lower end, which serves for the filling of the container. This opening opens at valve 22 into the air space above the contents of the preparation container, while a riser tube 50 is attached to the second valve 24 at opening 48; this riser tube reaches to close to the bottom of the preparation container.

Pass-throughs 44, 46 are connected, via separate conduits 52, 54 located in housing block 42, with a receiving space for spray nozzle 58; this space opens in the housing wall of spray head housing 12. Spray nozzle 58 in turn is made up of a spray insert 60 inserted in receiving space 56 and a small spray plate 62 which is attached to the spray insert. The separate conduits 52, 54 are brought together in spray nozzle 58 in a manner known of itself, in such a way that compressed air and preparation liquid, which are admitted separately via conduits 52 and 54 respectively, are mixed and blown out via discharge nozzle opening 64 provided in spray plate 62 as a finely atomized conical jet. One end of extended spray insert 60 is inserted into conduit 54 and has a passage opening 59, whose discharge end opens into receiving space 56 and is directed into discharge nozzle opening 66 in spray plate 62. Between the opening of spray insert 60 and discharge nozzle opening 64 there is a ring slit, through which the compressed air which flows in via conduit 52 can pass and thus can aid in breaking up the preparation to be atomized coming out of passage opening 59 in spray insert 60.

The section of extended spray insert 60 which is located in receiving space 56 is provided with an external thread 61, onto which an internally threaded, sleeve-shaped attachment 65 of spray plate 62 is screwed. It also provides a tight seal against the outside. In order to assure that the compressed air which flows in via conduit 52 can also flow in the required manner to the ring slit between the opening of spray insert 60 and discharge nozzle opening 64, two (or more) longitudinal grooves are provided in the region of spray insert 60 which has the external thread. The depth of these grooves is greater than the height of the screw thread of external thread 61, so that these longitudinal grooves comprise flow channels for the compressed air.

It is possible to change the size of the ring slit between the opening of spray insert 60 and discharge nozzle opening 64, by changing the distance to which sleeve-shaped attachment 65 is screwed onto spray insert 60. In order to enable the this distance to be changed simply and rapidly, a handle is provided on spray plate 62. It projects in the form of an enlarged-diameter trough- or funnel-shaped attachment, whose peripheral surface can also be milled or roughened in some other way so as to permit the rotational force exerted with the fingers or with an auxiliary tool to be converted accurately into the desired movement of the screw.

Pass-through 46 in housing block 42 is closed off at its upper end by a dome-shaped membrane 66 made of elastically deformable plastic. It is held by a snap-in safety ring 68 in a recess provided for it in housing block 42. This membrane 66 thus closes pass-through 46 in a pressure-tight manner at its upper side, but because of its elastic deformability, it allows valve shaft 40 of closure body 28 of valve 24 to be inserted. Valve-closure body 28 is actuated by an actuation cap 70 which is mounted on the side of housing 12 which faces the container and overlaps the upper end of spray head housing 12. Cap 70 has actuation stems 72, 74 which project at the inner side of its front face for each valve-closure body 26, 28. The free front ends of these stems face the free ends of valve shafts 40. Actuation cap 70 held onto housing 12 of spray head 10 and can be displaced perpendicularly over a prescribed actuation path. The position shown in FIG. 1 is the starting position, in which actuation cap 70 is in the unactuated starting position, in which valves 22 and 24 are closed. It can also be seen in FIG. 1 that actuation stem 72 associated with closure body 26 sits directly on the free front end of valve shaft 40, so that valve 22 is opened immediately when actuation cap 70 is pressed down. In contrast, the front end of actuation stem 74 rests on the outer side of arched membrane 66, while the front end of valve shaft 40 is still some distance away from the inner surface of the membrane. That is, when actuation cap 70 is depressed, closure body 26 is first, and immediately displaced and thus valve 22 opens; while valve body 28 is only opened with a time delay when actuation cap 70 is depressed further. When the spray head is closed by releasing the previously depressed actuation cap, closure body 28 of valve 24 closes first, and then closure body 26 of valve 22.

Actuation stem 72 is surrounded coaxially by a tubular extension 76, which projects on the container side over the front end of actuation stem 72 and engages exactly into pass-through 44. Extension 76 can be displaced longitudinally in pass-through 44 and is brought in a tightly-sealed manner against the outlet of compressed air into the interior of actuation cap 70. The compressed air supplied by the compressed air source is carried to the annular space between actuation stem 72 and tubular extension 76 by means of an attachment extension 78, to which the end of a compressed air line—suitably comprising an elastic hose—is attached, through which compressed air supplied by the compressed air source is fed in.

The functioning of spray head 10 in accordance with the invention can also be seen from the foregoing description. When actuation cap 70 is depressed, as already mentioned, valve 22 (FIG. 1) is first opened by actuation stem 72, so that the compressed air admitted through attachment extension 78 from the air pump (which has first been placed in operation) is admitted not only via the annular space in conduit 52 between actuation stem 72 and annular extension 76, and from this through spray insert 60 through nozzle opening 64 of spray plate 62, but in addition the air space above the liquid in the preparation container is already placed under pressure via valve 22 (which is then opened). Only when, by further depressing actuation cap 70, the second actuation stem 74 opens closure body 28 of the second valve 24, does the increased pressure in the preparation container displace liquid through riser tube 50 and valve 24 into pass-through 46 and the connecting conduit 54 to spray insert 60, from which the preparation runs into and mixes with the air in the ring slit between the opening of the spray insert and nozzle opening 64. This mixture is then sprayed out from nozzle opening 64 of spray plate 62 in finely atomized form. When the spray head is closed by releasing the depressed actuation cap, the inflow of liquid preparation is first blocked off, because the closure body 28 of valve 24 is already released by the associated actuation stem 74, while closure body 26 of valve 22 is still displaced in the open position. As a result, pure compressed air still flows through conduit 52 to spray head 58 and blows the last residues of preparation remaining in the conduit system out of the nozzle. Then, as soon as valve 24 is also closed, no more residues of the preparation remain in the region of the spray nozzle, which could otherwise harden and plug the nozzle opening or could later flow out of the nozzle.

We claim:

1. A manually operated spray head for a spraying device comprising:

a spray head housing including a separating wall formed perpendicular to a longitudinal axis of the spray head housing, and at least portions of an air pressure canal and a product canal separately supplied to a spray nozzle and parallel to the longitudinal axis of the spraying device;

a valve housing positioned beneath the separating wall of said spray head housing, said valve housing including first and second valves operable with an initial tension in a closing position of which the first valve is positioned in a passage of the air pressure canal leading compressed air from a compressed air inlet to a product container interior, and the second valve is positioned inside a passage of the product canal transporting the product from a tube extending into the product container interior to the spray nozzle;

an actuating cap slidable in the longitudinal direction of said spraying device and fit on said spry head housing wherein the actuating cap includes two actuating taggets each allocated to one of the valves, respectively, which open the valves upon depression of the actuating cap; and wherein the actuating taggets are so dimensioned that the actuating tagget allocated to the first valve, when pressing down the actuating cap, engages with the first valve before the actuating tagget allocated to the second valve engages with the second valve;

wherein each of the valves includes a valve shaft and a guide shaft in a linear arrangement and joined together by a flanged valve plate, the flanged valve plate of the first valve being arranged below the separating wall and in said passage of the air pressure canal and being slidably fit in the longitudinal direction therein, wherein said passage of the air pressure canal terminates above the product in the container, the flanged valve plate of the second valve being arranged below said separating wall and in the passage of the product canal and being slidably fit in the longitudinal direction therein.

2. The spray head according to claim 1, wherein the flanged valve plates are each seated against a sealing disk located below the separating wall.

3. The spray head according to claim 2, wherein at least one of the sealing disks and the valve housing is made of plastic material.

4. The spray head according to claim 1, wherein the portion of the product canal of the spray head housing on an actuating cap side is closed by a deformable elastic membrane that allows for an interspace between a free end of the valve shaft of the second valve and a free end of the respective actuating tagget.

5. The spray head according to claim 1, wherein, from an inner surface of the actuating cap, a tubular nipple surrounding the actuating tagget for the first valve extends and is slidable in a longitudinal direction and forms the portion of the air pressure canal of the spray head housing, and whereby in a circular space formed between the tubular nipple and the actuating tagget is said compressed air inlet.

6. The spray head according to claim 1, wherein at least one of the spray head housing and the actuating cap is injection-molded as one piece of plastic material.

7. The spray head according to claim 1, wherein the valves are each injection-molded as one piece of plastic material.

8. The spray head according to claim 1, wherein said valve shaft protrudes in one direction from said flanged valve plate and said guide shaft protrudes in an opposing direction from said flanged valve plate and wherein a spiral spring surrounds each guide shaft such that the spiral spring biases the flanged valve plate in the closing position.

9. The spray head according to claim 1, wherein the spray nozzle includes a spray plate and a spraying insert inserted in a receiving space of the spray plate, said spraying insert having an elongated passage opening joining with the portion of the product canal of the spray head housing, the elongated passage opening having a calibrated mouthpiece which is focused to a discharge nozzle point that is constructed in said spray plate, an inside of the spray plate and an exterior of the spraying insert forming an interspace which communicates with the portion of the air pressure canal of the spray head housing, whereby, between the mouthpiece of the spraying insert and the discharge nozzle point, a circular slot is formed for the passage of compressed air flowing through the air pressure canal.

10. The spray head according to claim 9, wherein the exterior of the spraying insert positioned in the interspace is provided with an external thread onto which a cartridge-shaped attachment of the spray plate is screwed, sealing the interspace tightly to the outside, whereby a threaded grip of the external thread of the spraying insert and of the internal thread of said cartridge-shaped attachment of the spray plate is shaped to allow the compressed air flowing into the interspace to continue flowing further to the discharge nozzle point.

11. The spray head according to claim 10, wherein the spray plate has an attachment which protrudes from the spray housing which regulates a screwing depth of the cartridge-shaped attachment of the spraying insert and thus controls a size of the circular slot between the mouthpiece of the spraying insert and the discharge nozzle point.

* * * * *